US012788162B2

(12) United States Patent
Visconti et al.

(10) Patent No.: US 12,788,162 B2
(45) Date of Patent: Nov. 10, 2026

(54) REFRIGERATED DISPLAY CABINET WITH TWO-AREA DISPLAY COMPARTMENT

(71) Applicant: EPTA S.p.A., Milan (IT)

(72) Inventors: Federico Visconti, Milan (IT); Maurizio Orlandi, Milan (IT); Stefano Trabucchi, Milan (IT); Lionel Vasseur, Milan (IT); Patrick Cazalis, Milan (IT); Laurent Narbaitz, Milan (IT); Alexandre Miskizak, Milan (IT); Julien Granouillac, Milan (IT)

(73) Assignee: EPTA S.P.A., Milan (IT)

( * ) Notice: Subject to any disclaimer, the term of this patent is extended or adjusted under 35 U.S.C. 154(b) by 445 days.

(21) Appl. No.: 18/307,499

(22) Filed: Apr. 26, 2023

(65) Prior Publication Data

US 2024/0074600 A1 Mar. 7, 2024

(30) Foreign Application Priority Data

Apr. 27, 2022 (IT) ..... 102022000008306

(51) Int. Cl.
*A47F 3/04* (2006.01)

(52) U.S. Cl.
CPC ..... *A47F 3/0447* (2013.01)

(58) Field of Classification Search
CPC ..... A47F 3/0447; A47F 2003/046; F25D 2317/0682; F25D 2323/00281
See application file for complete search history.

(56) References Cited

U.S. PATENT DOCUMENTS

| | | | | |
|---|---|---|---|---|
| 2,836,039 | A | 5/1958 | Weber | |
| 3,756,038 | A | 9/1973 | MacMaster et al. | |
| 2003/0172670 | A1* | 9/2003 | Vormedal | A47F 3/0447 62/255 |

(Continued)

FOREIGN PATENT DOCUMENTS

DE 202021100693 U1 * 5/2021 ..... A47F 3/0443

OTHER PUBLICATIONS

Translated_Thomas (Year: 2021).*
Italian Search Report for Patent Application No. IT 202200008306, mailed Dec. 13, 2022, The Hague, NL.

*Primary Examiner* — Elizabeth J Martin
*Assistant Examiner* — Samba Gaye
(74) *Attorney, Agent, or Firm* — Armstrong Teasdale LLP

(57) ABSTRACT

A refrigerated display cabinet has a containment structure defining a product display compartment divided by a shelf into a lower area and an upper area, and an access opening, an air inlet mouth and an air outlet mouth being in communication with the product display compartment. A channel connecting the air inlet and outlet mouths contains an evaporator connected to a refrigeration circuit and a plurality of fans arranged downstream of the evaporator, and is divided into a first group and a second group of fans respectively generating a flow of refrigerated air towards the lower area and a flow of refrigerated air towards the air outlet mouth. A control unit adjusts speed of the first group of fans independently of speed of the second group of fans and flow rate of refrigerated air towards the lower area independently of flow rate of refrigerated air towards the air outlet mouth.

13 Claims, 11 Drawing Sheets

(56) References Cited

U.S. PATENT DOCUMENTS

| | | | | |
|---|---|---|---|---|
| 2010/0033923 | A1* | 2/2010 | Copeland | H05K 7/20736 361/679.53 |
| 2016/0220040 | A1* | 8/2016 | Resch | A47F 3/0447 |
| 2017/0150829 | A1* | 6/2017 | Bates | F25D 17/06 |
| 2017/0340138 | A1* | 11/2017 | Nooli | F25D 17/06 |

* cited by examiner

REFRIGERATED DISPLAY CABINET WITH TWO-AREA DISPLAY COMPARTMENT

CROSS-REFERENCE TO RELATED APPLICATION

This application claims priority to Italian Patent Application No. 102022000008306 filed Apr. 27, 2022, the entire contents of which is hereby incorporated in its entirety by reference.

FIELD OF THE INVENTION

The present invention relates to a refrigerated display cabinet with two-area display compartment.

The refrigerated display cabinet according to the present invention finds particular application in the commercial refrigeration field.

BACKGROUND ART

When selling fresh foodstuffs, it is necessary that the latter are kept refrigerated at a positive temperature, for example between −1° C. and +5° C. for a correct storage which avoids the qualitative and hygienic deterioration thereof.

In public sales areas, refrigerated display cabinets or counters are used, which are adapted to visually display the goods so that they can be purchased. In order not to obstruct the visibility of the fresh product, both packaged and unpackaged, refrigerated display cabinets of the closed type are used, in which the display compartment is closed by doors which are transparent or of the open type, in which the display compartment is directly open towards the outside and without doors.

Refrigerated display cabinets operating with thermodynamic vapor-compression cycles generally contain at least one evaporating section in which the evaporation of a coolant fluid removes heat from the air inside the refrigerated display cabinet circulated in a forced manner by ventilation means or by natural circulation.

The basic mechanism through which food loses heat is substantially dependent on the heat exchange mechanisms between the foodstuffs and the surrounding environment. Conventionally, in open display cabinets, food typically acquires heat by radiation from the external hot parts and is cooled by cold air from the evaporator of the cabinet and is suitably conveyed towards the most heated foodstuffs.

In refrigerated display cabinets, and in particular the vertical ones with shelves, it is known that the display compartment is closed by air curtains to insulate the goods from the surrounding warm environment. The air curtain has the dual purpose of separating the air inside the cabinet from the air outside, to reduce the convective heat exchange and, as shown, to bring cold air close to the foodstuffs to remove the heat radiated thereon by the external environment if open and by the inside wall of the door if closed. The air curtain is the only means that prevents the infiltration of hot air in open cabinets, but it also makes a useful contribution to insulation in closed versions.

The effectiveness of the air curtains is strongly linked to the interaction between the air flows inside the cabinet and those outside, for example generated by natural convection or from the environmental cooling and conditioning system. The main parameters are: thickness and speed of the air curtain; length of the air curtain, i.e., the space that the air travels from an outlet grille to an intake grille; inclination of the air curtain. Furthermore, an air curtain is significantly affected by the variations in air density and temperature, parameters which, in turn, are a function of heat transport mechanisms. In turn, heat transport, i.e., the exchange of thermal energy, requires that moving air masses are there even in stationary environmental conditions.

As shown in FIG. 1, the air curtains enclose the product between the front part of the cabinet (open or closed by transparent doors) and the rear part of the cabinet, which houses the technical section with the evaporator and fans which generate the air flow rate necessary to feed the air curtain. The air thus recirculates in a sort of ring which surrounds the part to be refrigerated and which, in the most conventional version, places the delivery grille A, the intake grille B, the fans V and the evaporator E in an aerodynamic series.

In the art, many possibilities are known for arranging air curtains to improve a basic performance. For example, several air curtains may be arranged, nested one inside the other, or the refrigerated space may be divided into a number of air curtains in sequence, but shorter in length.

Air curtains are often supported by a part of air flow rate which comes from the rear part of the refrigerated compartment, or "back panel", and crosses the display compartment, contributing to the vertical stability of the curtain.

Usually, the air curtain circulates from the top to the bottom, aided by the greater density of the circulating air, this being at a lower temperature than room temperature. As it descends towards the intake grille, the air curtain heats up due to the heat exchange with the foodstuffs, and especially due to the mixing with the air outside the cabinet, which is caused by the turbulence of the fluid. For such a reason, in some types of vertical refrigerated cabinets, the lower part I of the cabinet is therefore that with the higher temperature. In a refrigerated cabinet, the higher temperature defines the performance of the cabinet in terms of maximum temperature reached by the foodstuffs when used correctly. For example, the ISO 23953 standard defines the different temperature classes while also defining the test method. The upper part S of the cabinet, on the other hand, is at a temperature which is unnecessarily lower, since it does not contribute to improving the overall performance of the cabinet and also has the drawback of increasing the heat which penetrates the cabinet by radiation, thus increasing the overall energy consumption thereof.

In order to obviate this problem, embodiments are known in which the flow rate of refrigerated air sent to the lower part of the cabinet is increased with a dual purpose:

- increasing the speed of the air which hits the foodstuffs (especially in the step portion of some conventional hard discount loadings, as shown in FIG. 2, corresponding to FIG. 26 of ISO23953-2:2015) thus increasing the local convective heat transfer coefficient; and
- at the same time, injecting air at a lower temperature than that from the delivery grille to reduce the average temperature thereof and therefore remove more heat from the foodstuffs.

Increasing the speed of the air and the thermal gradient in the lower part of the cabinet allows decreasing such parameters in the upper part by the amount not required to reach the performance class limit temperature. The overall result obtained is to better balance the performance achieved and thus reduce energy consumption.

However, generating such a flow of refrigerated air in the lower part of the cabinet is problematic, since it requires increasing the volume and plant engineering complexity of the technical section of the cabinet.

The internal refrigerated volume of a cabinet defines the capacity of the cabinet itself; to maximize the capacity (i.e., the volume available for storing foodstuffs) it is therefore necessary to minimize the volume occupied by the technical section usually placed in the lower and rear part of the cabinet (as shown in FIG. 1). Therefore, such a need clashes with the technical need to increase the volume of the technical section.

Furthermore, there is a cost minimization problem; in fact, each additional mechanical member penalizes the cost-effectiveness of the solution.

A known solution consists in distributing the flow of refrigerated air which flows in the rear part of the refrigerated compartment or "back panel", by means of partitions placed downstream of the evaporator, therefore downstream of the colder air source, thus dividing such a flow into a part to be introduced into the upper area of the cabinet and a part to be introduced into the lower area. An example of such a solution is shown in FIG. 3.

However, such a solution has limitations.

A first limitation is linked to the fact that the distribution of the flows depends on the speed of the air flow generated by the fans placed upstream of the evaporator; the distribution valid for a defined speed is not equally optimal for different speeds of the air. Furthermore, the speed of the air flow, even given the same fan rotation speed, is influenced by the amount of frost present in the evaporator. In addition, other factors, such as the variation in air density, determined by the moisture content, can affect the degree of distribution.

A second limitation (probably the main one) is linked to the fact that such a method of distributing the flows imposes an inversion of 180 degrees to the flow to be introduced into the lower area of the cabinet. To compensate for the loss of speed linked to the reversal of motion, larger sections would be required for the lower recirculation flow rate, in contrast with the need to minimize the space of the technical compartment. Therefore, such a method is only suitable for cases in which the flow rate to be introduced into the lower area is a smaller fraction of the flow rate which must instead continue towards the upper area.

In the context of commercial refrigeration there is therefore the need to have refrigerated display cabinets with two-area display compartment which overcome the technical limits mentioned above, present in prior art solutions.

SUMMARY OF THE INVENTION

Therefore, it is the object of the present invention to eliminate or at least mitigate the drawbacks of the prior art mentioned above, by providing a refrigerated display cabinet with two-area display compartment which allows distributing the flow of refrigerated air between an upper area of the cabinet and a lower area of the cabinet in an easily adjustable manner.

It is a further the object of the present invention to provide a refrigerated display cabinet with two-area display compartment which allows distributing the flow of refrigerated air between an upper area of the cabinet and a lower area of the cabinet in an easily adjustable manner, without penalizing the capacity of the cabinet given the same size of the cabinet itself.

It is a further object of the present invention to provide a refrigerated display cabinet with two-area display compartment, which is constructionally simple to manufacture, with plant costs comparable to conventional plants.

It is a further object of the present invention to provide a refrigerated display cabinet with two-area display compartment, which is reliable and operatively simple to manage.

BRIEF DESCRIPTION OF THE DRAWINGS

The technical features of the invention according to the aforesaid objects can be clearly found in the contents of the claims hereinbelow and the advantages thereof will become more apparent from the following detailed description, given with reference to the accompanying drawings which show one or more embodiments thereof merely given by way of non-limiting example, in which:

Elements or parts in common to the embodiments described will be indicated hereafter using the same reference numerals.

DETAILED DESCRIPTION

Figure 1:
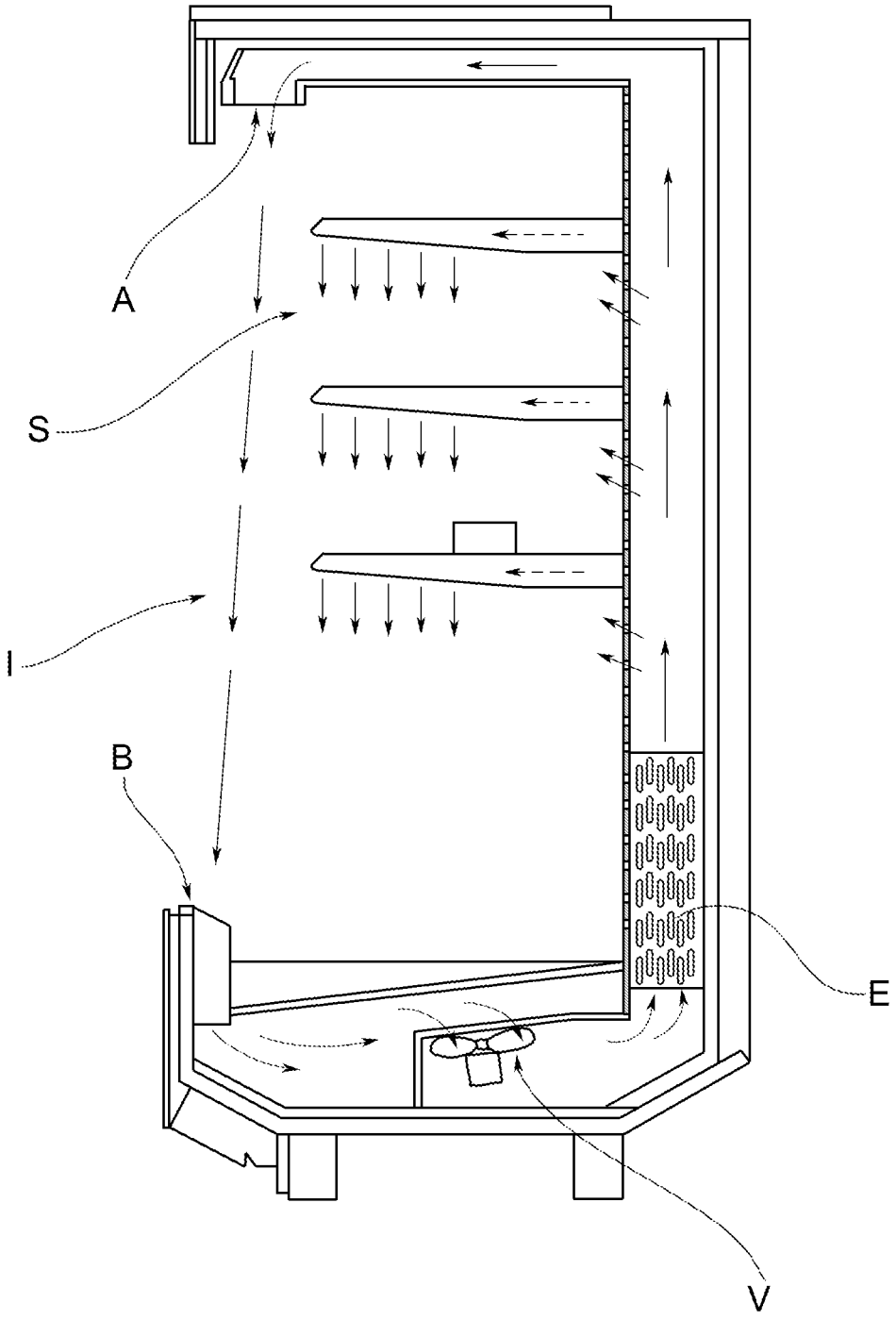
FIG. 1 shows an orthogonal, vertical section view of a refrigerated display cabinet of the conventional type.
Figure 2:
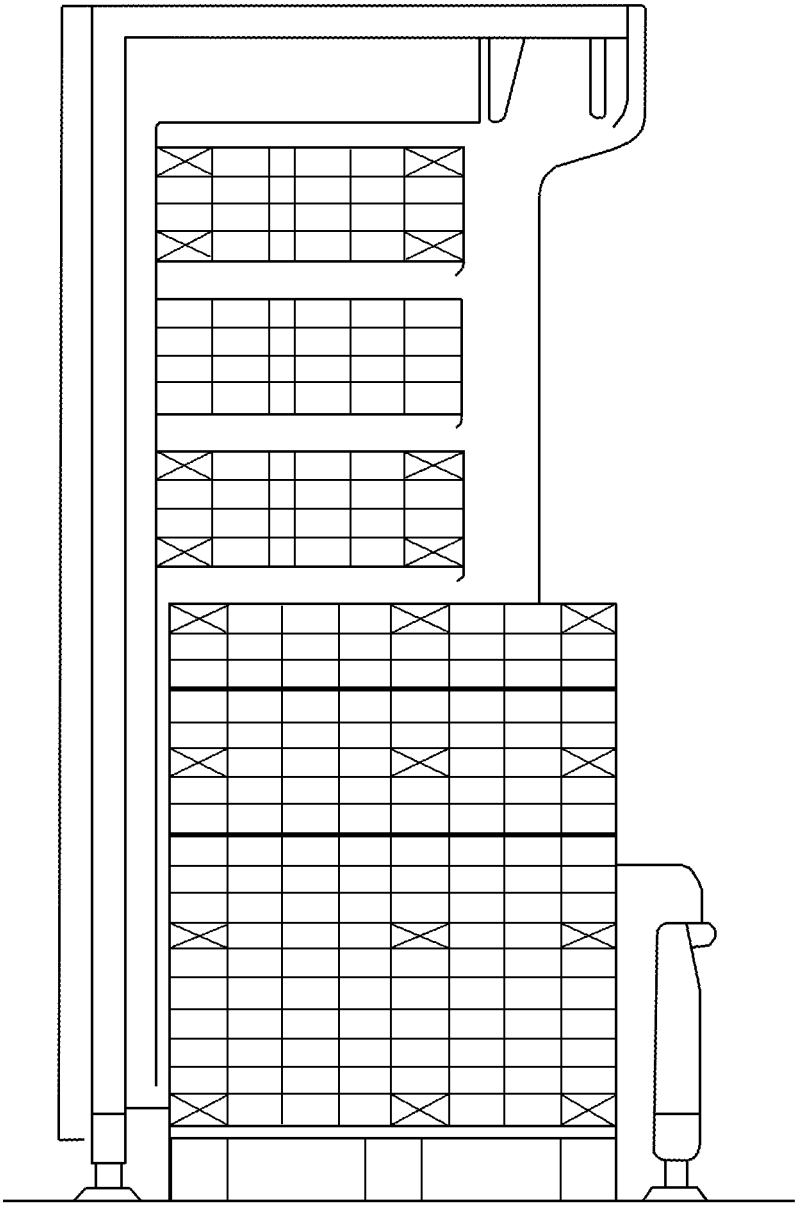
FIG. 2 shows a vertical section of a refrigerated display cabinet with a stepped portion of some conventional hard discount loadings, corresponding to FIG. 26 of ISO23953-2.
Figure 3:
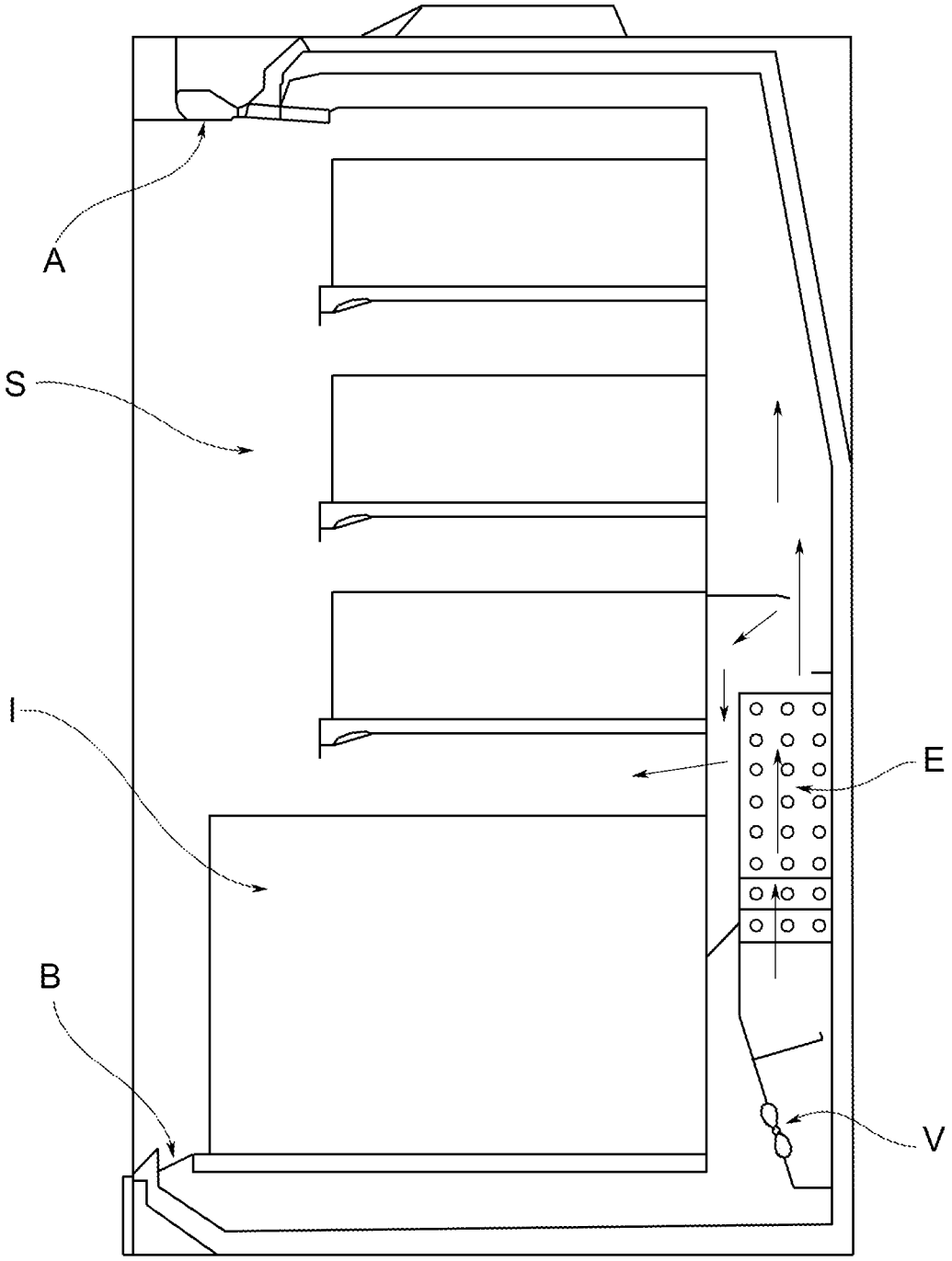
FIG. 3 shows an orthogonal, vertical section view of a refrigerated display cabinet of the conventional type with distribution of the flow of refrigerated air by means of partitions or deflectors installed downstream of the evaporator.

The present invention relates to a refrigerated display cabinet with two-area display compartment.

With reference to the accompanying Figures, reference numeral 1 indicates as a whole a refrigerated display cabinet with two-area display compartment according to the present invention.

In accordance with a general embodiment of the present invention, the refrigerated display cabinet 1 comprises a containment structure 2 which defines a product display compartment 3 and an access opening 4 to such a compartment 3.

In particular, the containment structure 2 consists of a box-shaped body comprising a base for being supported on the ground (in particular it can consist of a tub), a rear wall, a top cover, as well as, preferably, two end side walls, or the predisposition for the connection with an identical cabinet for producing cabinets of a greater length.

On the cabinet 1 a main axis X can be identified, along which the cabinet extends in length, in particular between the two end side walls.

The product display compartment 3 comprises at least one shelf 3*a* which divides the compartment itself into a lower area 3' and an upper area 3".

The display compartment 3 can comprise other shelves arranged above the shelf 3*a*.

The access opening 4 can be lacking doors or it can be provided with transparent doors so as to completely close the display compartment from the outside.

Figure 4:
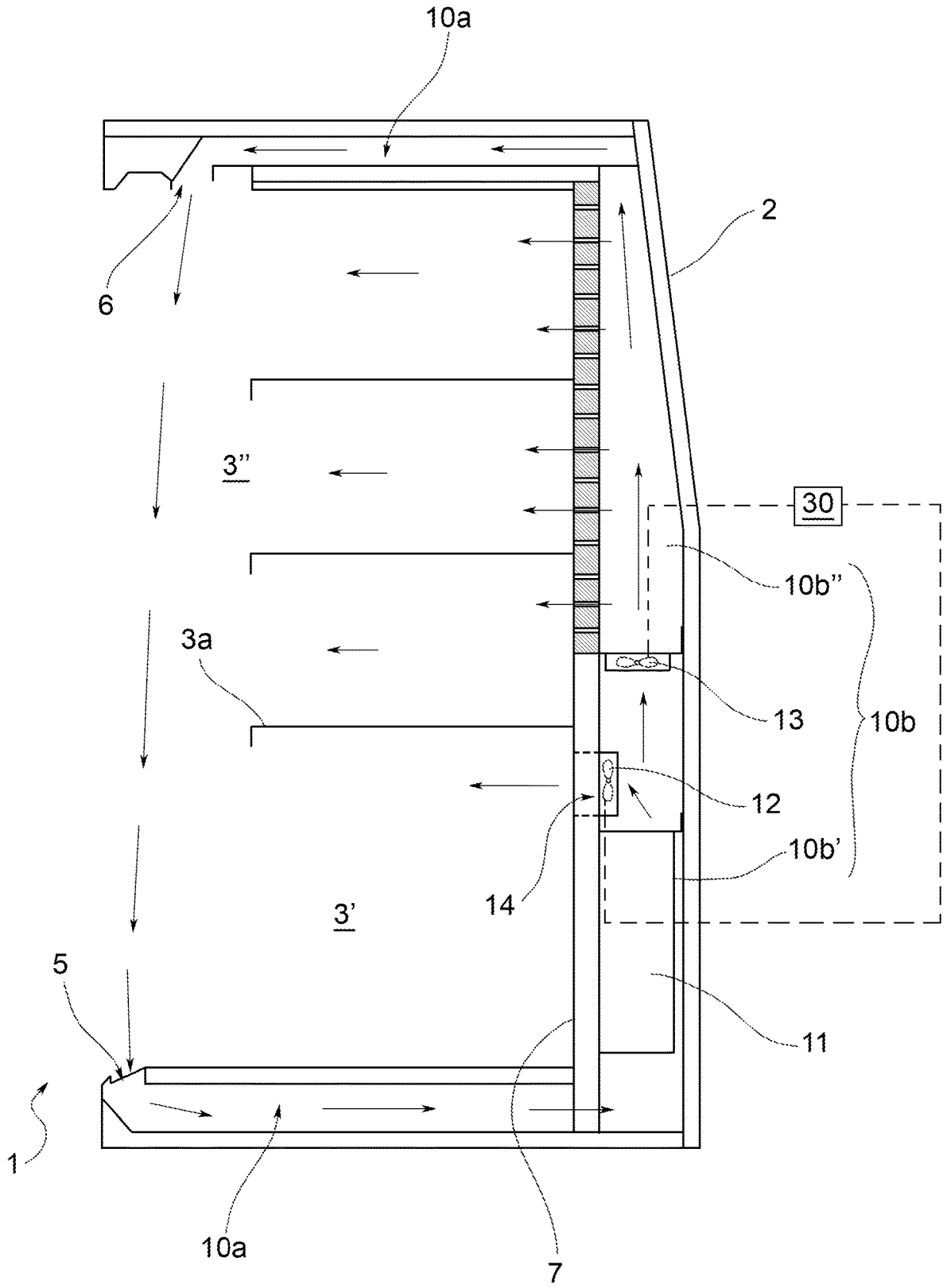
FIG. 4 shows an orthogonal, vertical section view of a refrigerated display cabinet in accordance with an embodiment of the present invention.
Figure 5:
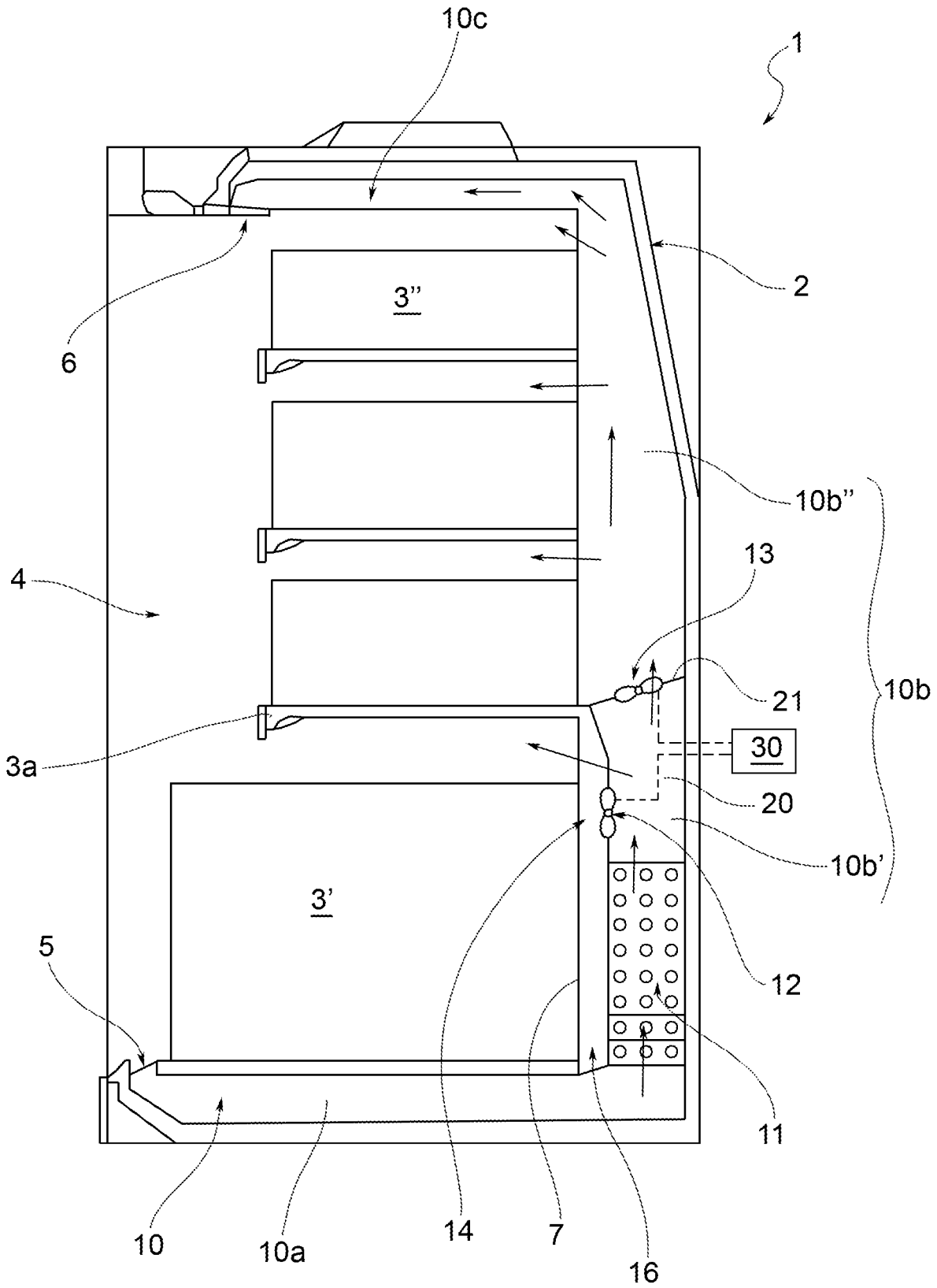
FIG. 5 shows an orthogonal, vertical section view of a refrigerated display cabinet in accordance with a further embodiment of the present invention.
Figure 7:
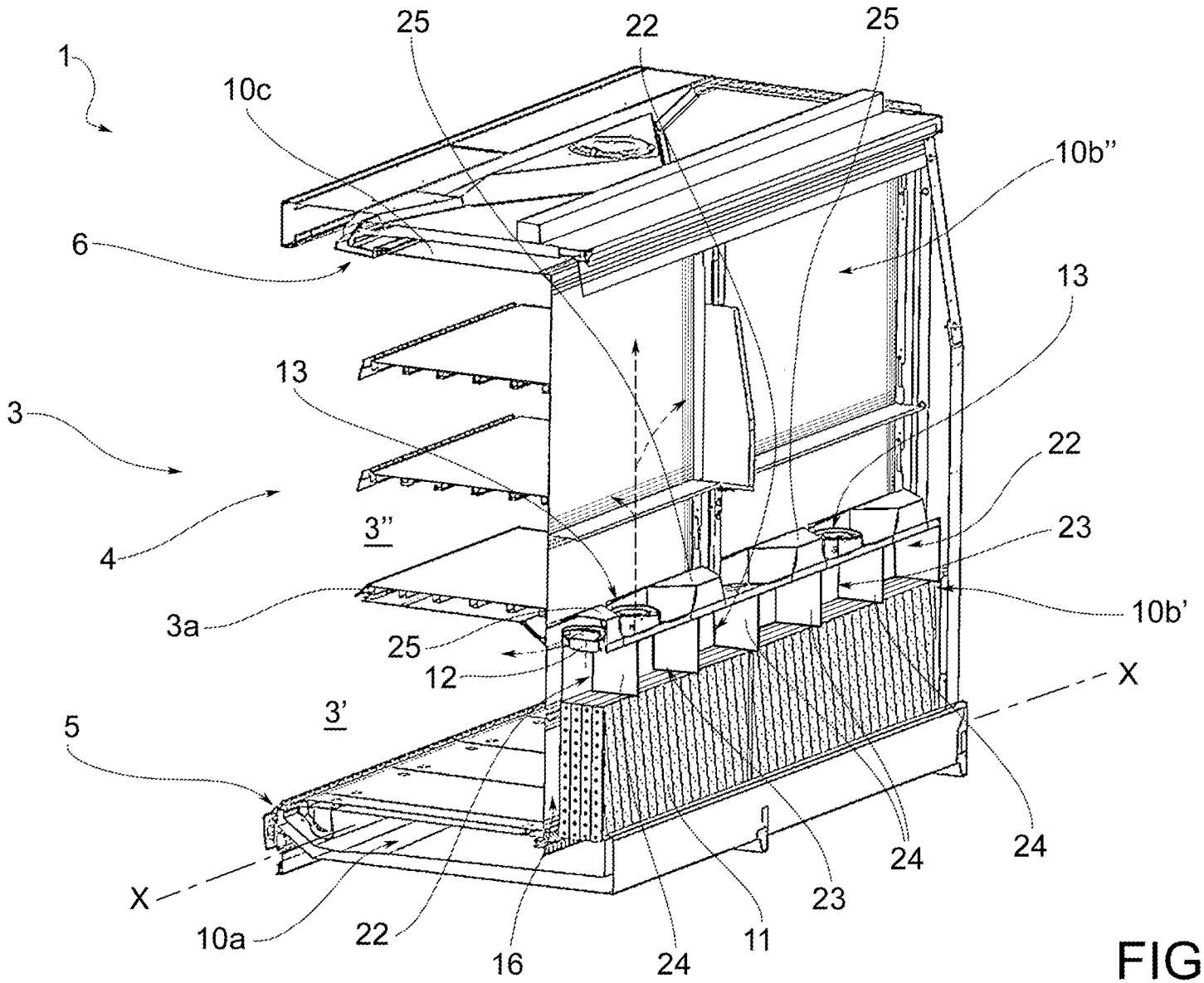
FIGS. 7 and 8 show two different perspective views of a display cabinet according to a preferred embodiment of the invention, with some parts removed to better highlight others.
Figure 8:
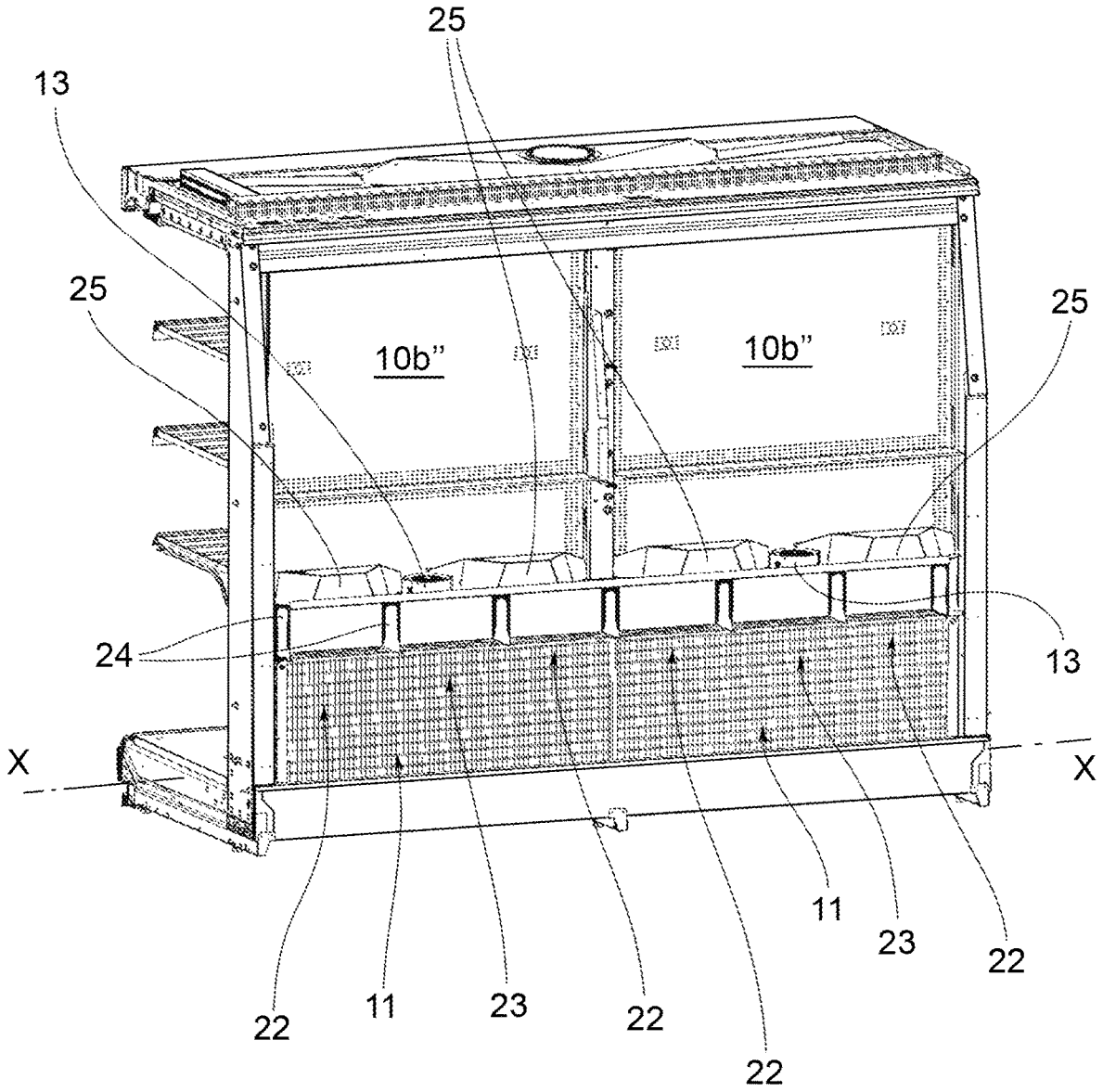
Figure 9:
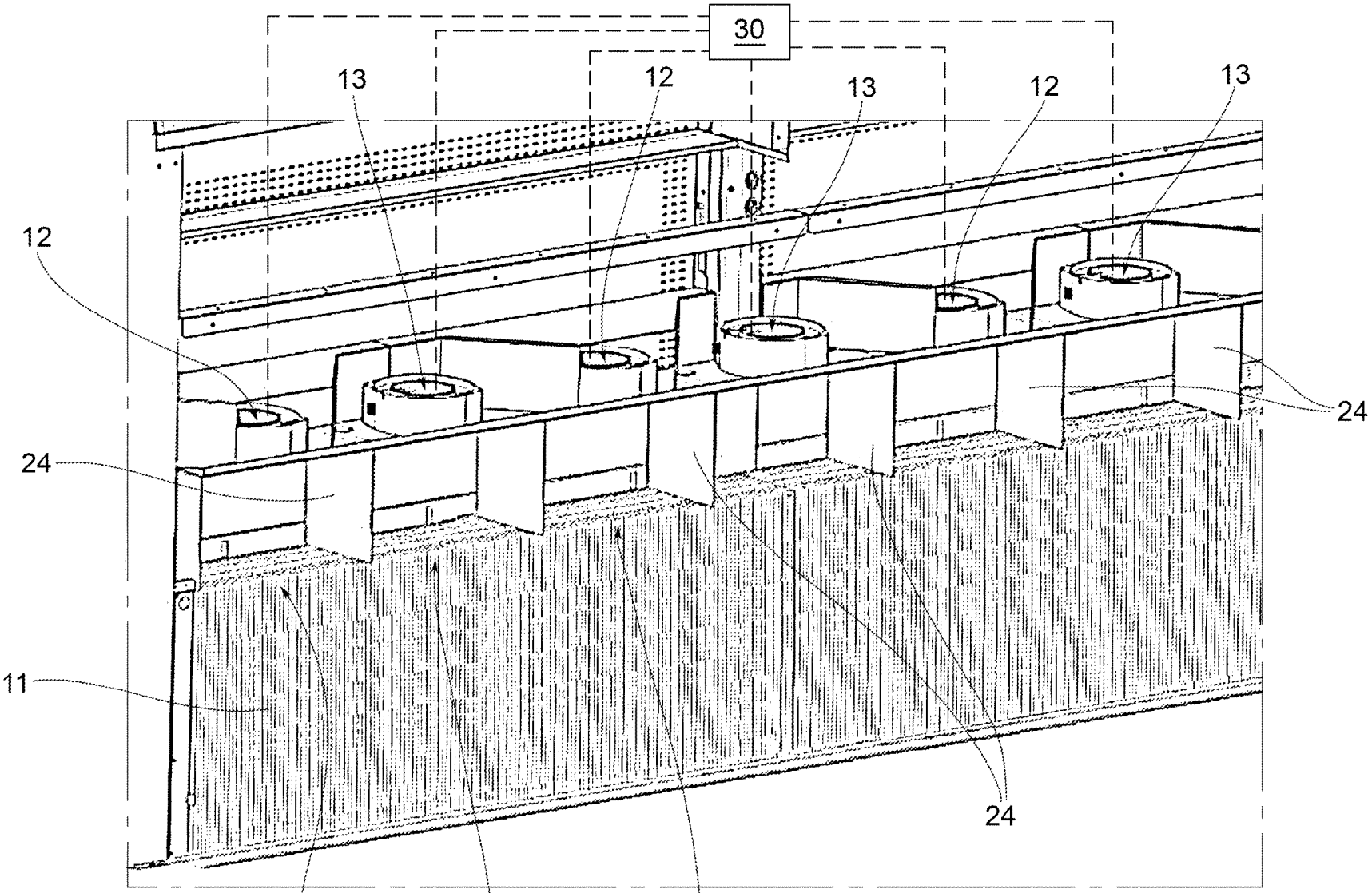
FIG. 9 shows an enlarged perspective view of a portion of the cabinet in FIG. 7.

As shown in particular in FIGS. 4, 5 and 7, the containment structure 2 further comprises an air inlet mouth 5 and an air outlet mouth 6 both communicating with the product display compartment 3. Advantageously, both mouths 5 and 6 can be provided with grilles or equivalent means.

The refrigerated display cabinet 1 further comprises a channel 10 which fluidically connects the air inlet mouth 5 to the air outlet mouth 6. Therefore, an air flow from the air inlet mouth 5 can be conveyed by the channel 10 towards the air outlet mouth 6. Thereby, a flow of refrigerated air is directed through the air outlet mouth 6 towards the air inlet mouth 5 along at least one portion of the access opening 4 in the form of an air curtain.

The channel 10 contains at least one evaporator 11 connected to a refrigeration circuit (not shown in the attached Figures) and a plurality of fans 12, 13. In use, the activation of the fans 12, 13 generates, in particular, a circulation of air inside the cabinet 1 or the channel 10; such an air flow, passing through the evaporator, cools down; a flow of refrigerated air is thus generated which is used to generate the cold air curtain and to cool the products contained in the display compartment 3.

The channel 10 communicates with the lower area 3' of the product display compartment 3 so as to directly introduce a flow of refrigerated air into such an area of the product display compartment 3.

Advantageously, as diagrammatically shown in FIG. 4, the channel 10 may also communicate with the upper area 3" of the display compartment 3 so as to introduce flows of refrigerated air also directly into such an area.

In accordance with a first aspect of the invention, the plurality of fans 12, 13 is arranged downstream of the evaporator 11 with respect to the direction of the air flow in the channel 10. This is an arrangement opposite to the that adopted in the solutions of the prior art, which instead provide for the positioning of the fans upstream of the evaporator.

In accordance with a second aspect of the present invention, the plurality of fans is divided into two groups:

- a first group of fans 12 is configured to generate a flow of refrigerated air towards the lower area 3' of the product display compartment 3; and
- a second group of fans 13 is configured to generate a flow of refrigerated air towards the air outlet mouth 6.

Advantageously, as shown in FIGS. 4, 5 and 7, the flow of refrigerated air generated by the fans of the second group 13 can be partially diverted inside the upper area 3" of the display compartment through openings obtained in a rear panel 7 of the display compartment 3 and, for the remaining part, flow towards the air outlet mouth 6 to create the air curtain at the access opening 4 to the display compartment 3.

The refrigerated display cabinet 1 comprises a control unit 30 which is programmed to adjust the speed of the first group of fans 12 independently of the speed of the second group of fans 13 so as to adjust the flow rate of refrigerated air towards the lower area 3' of the product display compartment 3 independently of the flow rate of refrigerated air towards the air outlet mouth 6 and possibly towards the upper area 3".

By virtue of the present invention, two independent ventilation circuits are configured:

- one for the lower area 3' of the display compartment 3; and
- one for creating the air curtain, and possibly for the upper area 3".

This is made possible by having inverted the relative position between the evaporator 11 and the fans 12, 13 in the aerodynamic circuit. In particular, by virtue of the fact of having positioned the evaporator lower down to gain more space, it also becomes possible to arrange the fans in the aforesaid two groups along the main axis X of the cabinet in the length direction.

The present invention provides a number of advantages.

A first advantage is that the flow rate of refrigerated air available for the lower area 3' of the display compartment 3 is linked to the sizing and number of fans of the first group 12. Therefore, the sizing and number of fans can be proportionate to the cabinet configuration needs. A request for a greater flow rate of refrigerated air in the lower area 3' can be met by thus increasing the number, type, or speed of the fans without increasing the sectional size of the channel and therefore without reducing the capacity of the cabinet 1.

A second advantage is linked to the fact that the two flow rates of refrigerated air (towards the lower section 3' of the product display compartment 3 and towards the air outlet mouth 6 are relatively independent of each other since each group of fans determines the total pressure upstream of the relative "ventilation conduit". It follows that the flow rates can be finely adjusted by adjusting the rotation speed of each group of fans. The sum of the two flow rates will constitute the overall flow rate which passes through the evaporator.

A further advantage is linked to the fact that the two flow rates of refrigerated air, no longer constrained by the geometry of the partitions/deflectors, can be also adjusted dynamically and in different manners according to the operating status, the environmental conditions or the actual temperature measured in the lower 3' and upper sections 3" of the product display compartment 3, as a result, for example, of changed conditions for loading the products into the cabinet 1.

A further advantage derives from the fact that the fine adjustment of the flow rates (to be carried out during the design verification in cabinet laboratory tests) can be done, as already described, without mechanical modifications. Therefore, this can be done without interrupting the tests with a rework and without having to restore the thermal regime of the test, which in some configurations can even take several days. The overall duration of a single test can be up to two weeks. Flow rate modifications can be made by acting on suitable parameters of the electronic controller.

Therefore, as opposed to the provision of the known art solutions, the relative distribution, and the absolute flow rate between the two areas of the cabinet is no longer linked to the sizing and the configuration of the deflectors. As already mentioned, instead, the distribution and the absolute flow rate can be controlled by operating directly on the fan speed, which can be easily program-controlled. Furthermore, by virtue of the fact that the fans are placed downstream of the evaporator, the possible presence of frost in the evaporator itself affects, to a lesser extent, the relative distribution between the flow rates of refrigerated air in the two ventilation circuits.

A further advantage is linked to the fact that the function performed by the deflectors, i.e., that of diverting a part of the flow of refrigerated air from the channel 10 towards the lower area 3' of the display compartment 3, can be performed directly by the fans of the first group. In fact, it is possible to position the fans of the first group vertically (i.e., with a horizontal rotation axis) so that they give the flow of refrigerated air a first deviation of 90°, thus passing from a vertical flow to a substantially horizontal flow.

Preferably, as shown in particular in FIGS. 4, 5 and 7, the channel 10 comprises:

- a first section 10*a* arranged at the base of the cabinet 1;
- a second section 10*b* arranged on the rear wall of the cabinet 1 in a position opposite to the access opening 4; and
- a third section 10*c* arranged at the top of the cabinet.

The three sections are joined together in sequence to form the channel 10.

The air inlet mouth 5 communicates with the first section 10*a*, and in particular it is obtained at the beginning of the first section. The evaporator 11 and the plurality of fans 12, 13 are in the second section 10*b*. The air outlet mouth 6 communicates with the third section 10*c*, and in particular it is obtained at the end of the third section.

Preferably, the second section 10*b* of channel 10 is divided into:

- a lower section 10*b'*, extending from the area for the connection with the first section 10*a* substantially up to the height of the shelf 3*a*, and
- an upper section 10*b"*, substantially extending from the height of the shelf 3*a* up to the area for the connection with the third section 10*c*.

In other words, the lower section 10*b'* extends at the lower area 3' of the product display compartment 3, while the upper section 10*b'* extends at the upper area 3" of the compartment 3.

More in detail, the evaporator 11 is housed in the lower section 10*b'* of the second section 10*b* near the first section 10*a*, while the plurality of fans 12, 13 is housed in the lower section 10*b'* of the second section 10*b* substantially at the height of the shelf 3*a*, in a connection area between the lower section 10*b'* and the upper section 10*b"*.

Figure 10:
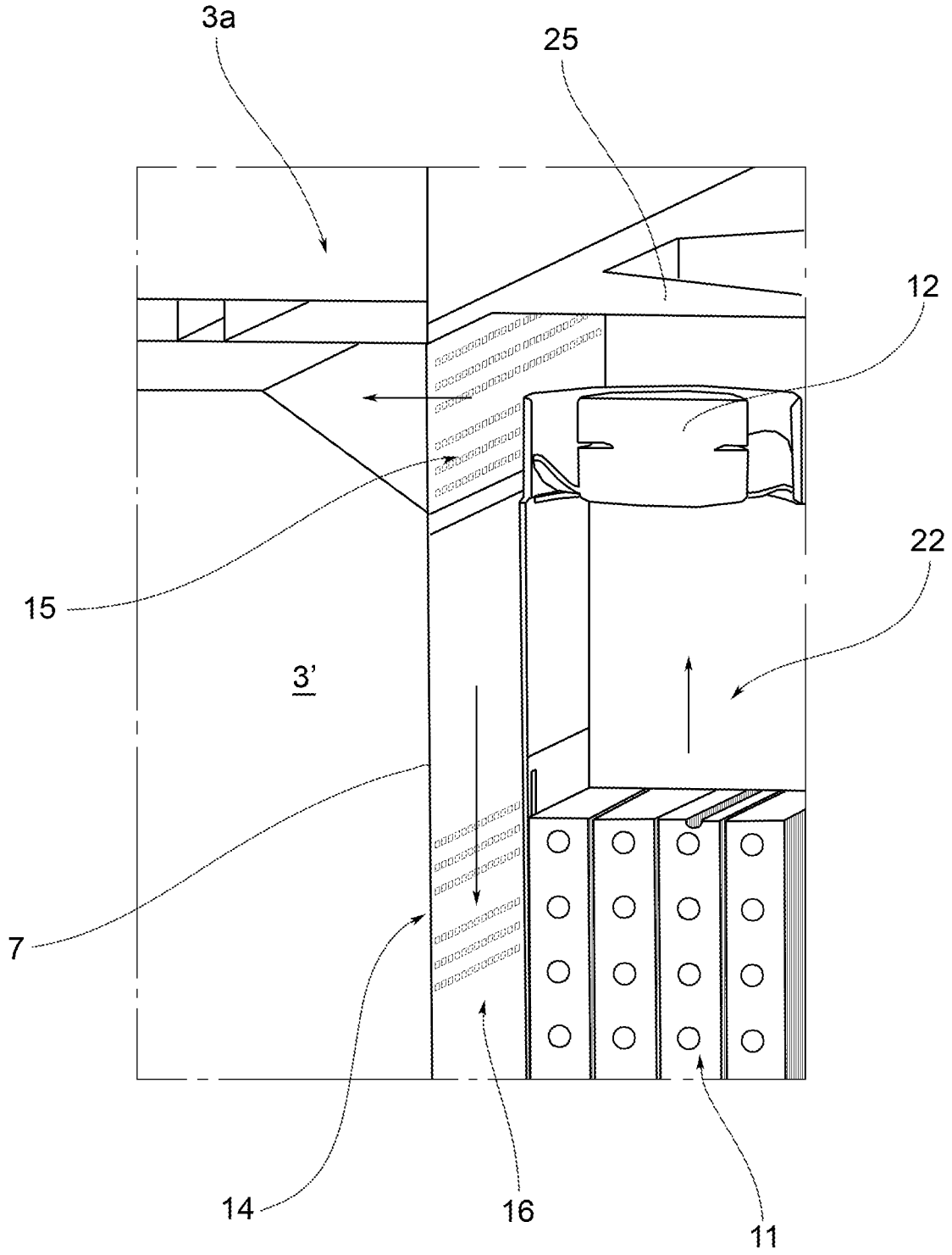
FIG. 10 shows a part of the cabinet shown in FIG. 7 relating to an air space between a rear panel and a channel which fluidically connects an air inlet mouth to an air outlet mouth.

Advantageously, the channel 10 is in communication with the lower area 3' of the product display compartment 3 by means of a first connection opening 14 obtained on a rear panel 7 of the display compartment 3, as indicated in FIGS. 4 and 5 and, in detail, in a preferred embodiment in FIG. 10.

Preferably, the refrigerated display cabinet 1 comprises an air space 16 obtained between a rear panel 7 of the product display compartment 3 and the lower section 10*b'* of the second section 10*b* of the channel 10.

The air space 16 allows creating an air circulation space along the entire rear panel 7 independently of the presence of the evaporator 11. Thereby, the position of the first connection opening 14 can be selected independently of the position of the evaporator 11.

In more detail, the first connection opening 14 puts the lower area 3' of the product display compartment 3 in communication with the air space 16. In turn, the air space 16 communicates with the second section 10*b* of the channel 10 by means of the first group of fans 12.

Preferably, the first connection opening 14 is obtained below the shelf 3*a*, preferably near it.

Advantageously, the shelf 3*a* can be a blowing shelf which is fluidically connected to the channel 10 by means of a second connection opening 15 obtained on a rear panel 7 of the display compartment 3.

In more detail, the second connection opening 15 puts the blowing shelf in communication with the air space 16. In turn, the air space 16 communicates with the second section 10*b* of the channel 10 by means of the first group of fans 12.

As shown in FIG. 4, the refrigerated display cabinet 1 can be lacking an air space obtained between the rear panel 7 of the product display compartment 3 and the lower section 10*b'* of the second section 10*b* of the channel 10. In other words, the lower section 10*b'* of the second section 10*b* of the channel 10 is separated from the lower section 3' of the display compartment 3 only by the rear panel 7.

Advantageously, the number and size of the fans are selected when sizing the cabinet 1. For a balanced sizing of the fans, it can be advisable to manage the overall flow rate of refrigerated air with a higher number of fans but with a smaller overall size.

For example, a refrigerated display cabinet of the known type with a length of 3.75 m is provided with 6 fans. A refrigerated display cabinet 1 according to the present invention of equal size can be provided with 9 fans of which 4 from the first group and 5 from the second group or 6 from the first group and 3 from the second group.

The two groups of fans do not necessarily have the same number of fans. Preferably, the more symmetrical configuration provides that one group of fans has an even number of devices and the other group an odd number of devices. The greater symmetry contributes to a homogeneous distribution of the air in the areas of the display compartment.

Preferably, the fans 12 of the first group are arranged alternately with the fans 13 of the second group along the main axis X of the cabinet 1.

Figure 11:
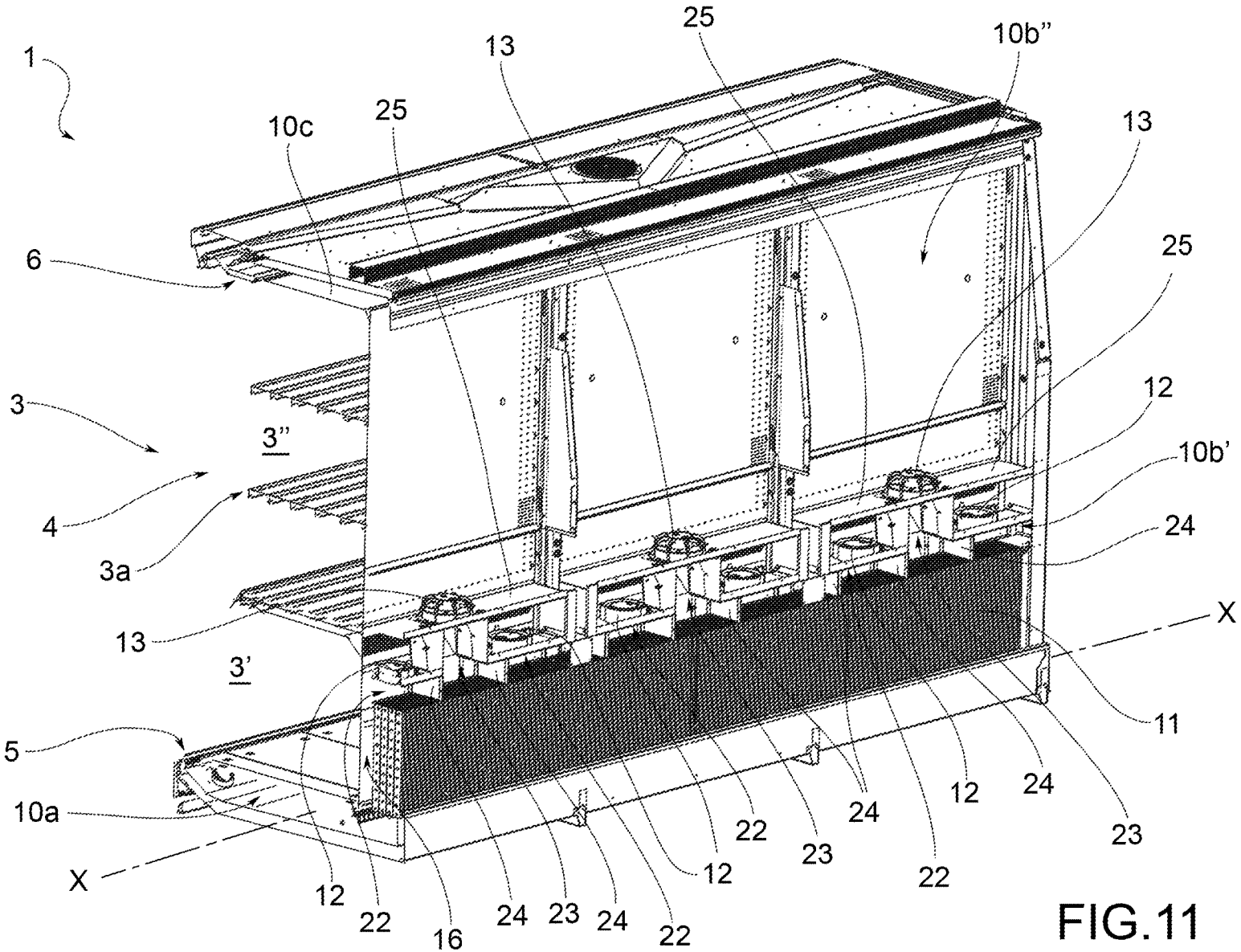
FIG. 11 shows a perspective view of a display cabinet according to a further preferred embodiment of the invention, with some parts removed to better highlight others.

The fans 12 of the first group can be arranged at the same height as the fans 13 of the second group (as shown, for example, in FIG. 7) or they can be staggered in height (i.e., in the direction orthogonal to the axis X) with respect to the fans 13 of the second group (as shown, for example, in FIG. 11).

Preferably, the plurality of fans 12, 13 consists of axial fans. Alternatively, the fans can be non-axial, for example centrifugal.

Figure 6:
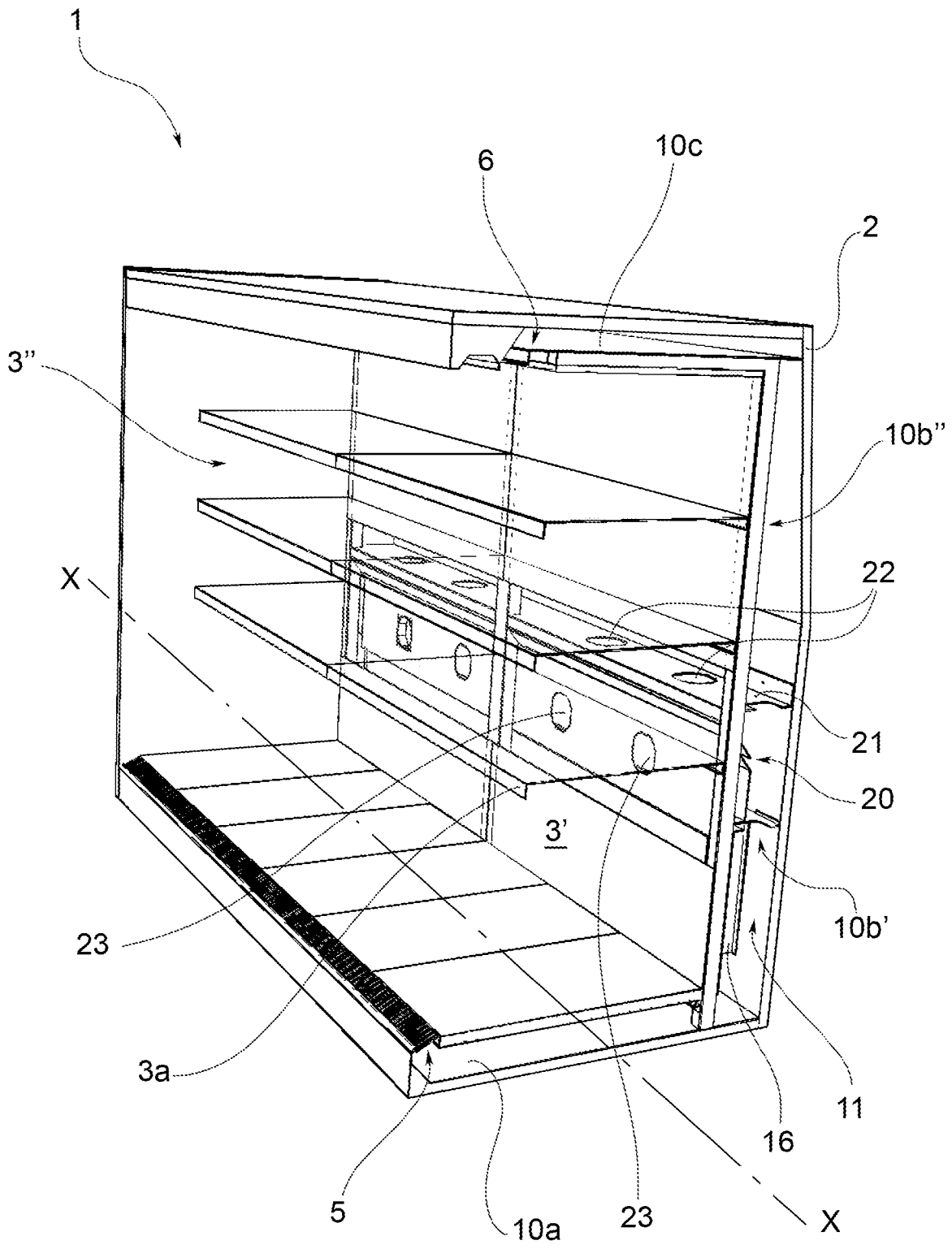
FIG. 6 shows a phantom perspective view of the refrigerated display cabinet in FIG. 5.

In accordance with the embodiments shown in FIGS. 4, 5 and 6, the fans 12 of the first group can be arranged substantially vertically with a substantially horizontal rotation axis to divert a part of the flow of refrigerated air from the evaporator 11 from the channel 10 towards the lower area 3' of the product display compartment 3, while the fans 13 of the second group can be arranged substantially horizontally with a substantially vertical rotation axis to direct the remaining part of the flow of refrigerated air from the evaporator 11 along the channel 10 towards the air outlet mouth 6.

By adopting the embodiment described above, the aforementioned further advantage of the present invention is obtained, which is linked to the fact that the function performed by the deflectors, i.e., that of diverting a part of the flow of refrigerated air from the channel 10 towards the lower area 3' of the display compartment 3, can be performed directly by the fans of the first group. In fact, it is possible to position the fans of the first group vertically (i.e., with a horizontal rotation axis) so that they give the flow of refrigerated air a first deviation of 90°, thus passing from a vertical flow to a substantially horizontal flow.

In accordance with the preferred embodiments shown in FIGS. 7 to 11, the fans 12 of the first group and the fans 13 of the second group can all be arranged substantially horizontally with a substantially vertical rotation axis. In this case, each of the fans 12 of the first group is associated with a deflector 25 configured to divert the flow of refrigerated air from the evaporator 11 from the channel 10 towards the lower area 3' of the product display compartment 3, in particular towards the air space 16.

In accordance with the embodiments shown in FIGS. 4, 5 and 6, the fans 12, 13 of both groups operate in suction on a common chamber 20 which is defined by a section of the channel 10 placed downstream of the evaporator 11 and by a dividing wall 21 arranged inside the channel section 10.

As shown in particular in FIG. 6, on the dividing wall 21 and on at least one wall of the channel 10 a plurality of through openings 22, 23 is obtained acting as seats for the fans 12, 13 of both groups.

In accordance with the two preferred embodiments of the invention shown in FIGS. 7 to 11, the evaporator 11 is preferably a finned evaporator which:

internally defines parallel passage channels for passage of the air flow through internal parallel fins, and is arranged inside the channel 10 so that such parallel passage channels are substantially aligned with the direction of the air flow along the channel 10, but they prevent the flow in the direction of the length of the cabinet or along the main axis X of the cabinet itself.

More in detail, in the section between the evaporator 11 and the fans 12, 13, the channel 10 is divided by means of partitions 24 into a plurality of conduits 22, 23.

Each of said conduits 22, 23 is configured to channel the flow of refrigerated air exiting a predefined number of parallel passage channels of the evaporator towards one of said fans 12, 13.

The conduits 22 coupled with the fans 12 of the first group intercept a number of parallel passage channels of the evaporator which is different from, preferably greater than, the number of parallel passage channels intercepted by the conduits 23 coupled with the fans 13 of the second group proportionately to the power required by the areas of the display compartment.

Preferably, in such two preferred embodiments, the fans of both groups 12 and 13 are all arranged horizontally with a vertical rotation axis. In this case, each of the fans 12 of the first group is associated with a deflector 25 configured to divert the flow of refrigerated air coming from the evaporator 11 from the respective conduit 22 towards the lower area 3' of the product display compartment 3, in particular towards the air space 16. Conversely, each of the fans 13 of the second group is not associated with any deflector and the flow generated by it is free to move towards the upper section 10*b*" of the second section 10*b* of the channel 10.

By virtue of such a configuration, the flows of refrigerated air treated by the individual fans are not only separated at the outlet of the evaporator 11 (as provided instead in the embodiments shown in FIGS. 4, 5 and 6), but right from the inlet section of the evaporator 11. As described, this is obtained by virtue of the presence of the partitions 24 which insulate the suction section of each of the fans until they join the fins of the evaporator 11, which are arranged orthogonally with respect to the main axis X of the cabinet 1. Thereby, the air flows from the finned evaporator 11 remain separated by the action of the fins coplanar to the partitions themselves. Furthermore, by arranging the deflectors 25 alternately at the delivery section of the fans 12 of the first group, it is possible to divert the flows generated by such fans towards the lower section 3' of the display compartment 3.

The separation of the air circuits up to the evaporator inlet has the following advantage. The air temperatures, equal at the evaporator inlet, can be made different at the outlet, since they depend on the width of the section available for each channel. Thereby, the suitable alternating arrangement of partitions and deflectors allows varying the outlet temperature of each of the two flows given the same evaporator sizing. Advantageously, each portion of the evaporator (defined by a predefined number of fins) can be sized according to the power required by the relative circuits.

This is to be considered in addition to the possibility of varying the flow rate thereof by acting on the number, size, and nominal speed for each of the two flows. Even for this solution, it becomes possible to dynamically adjust the relative flow rate of the two flows by changing the rotation speed of the fans during different cabinet operating steps or due to changed use conditions thereof.

The present invention allows achieving several advantages which have been outlined in the description.

The refrigerated display cabinet 1 with two-area display compartment according to the present invention allows distributing the flow of refrigerated air between an upper area of the cabinet and a lower area of the cabinet in an easily adjustable manner, simply by acting on the speed of the fans.

The refrigerated display cabinet 1 according to the present invention allows distributing the flow of refrigerated air between an upper area of the cabinet and a lower area of the cabinet in an easily adjustable manner, without penalizing the capacity of the cabinet given the same size of the cabinet itself.

The refrigerated display cabinet 1 according to the present invention is constructionally simple to manufacture, with installation costs comparable to those of conventional systems.

The refrigerated display cabinet 1 according to the present invention is reliable and operatively simple to manage.

Therefore, the invention thus conceived achieves the intended purposes.

Obviously, in the practical embodiment thereof, it may also take other shapes and configurations from that shown above, without departing from the present scope of protection.

Moreover, all details may be replaced by technically equivalent elements, and any size, shape, and material may be used according to the needs.

What is claimed is:

1. A refrigerated display cabinet with two-area display compartment, comprising:

a containment structure defining a product display compartment, divided by a shelf in a lower area and in an upper area, and an access opening to the product display compartment, wherein the containment structure comprises an air inlet mouth and an air outlet mouth both in communication with the product display compartment;

a channel that fluidically connects the air inlet mouth with the air outlet mouth so as to direct a first flow of refrigerated air through the air outlet mouth towards the air inlet mouth along at least one portion of the access opening in the form of an air curtain, wherein said channel contains at least one evaporator connected to a refrigeration circuit and a plurality of fans, and wherein said channel is in communication with the lower area of the product display compartment to directly introduce a second flow of refrigerated air in the lower area of the product display compartment, wherein said plurality of fans is arranged downstream of the evaporator with respect to an air flow direction in the channel, wherein said plurality of fans are arranged with a rotational axis thereof extending parallel to a vertical axis of said refrigerated display cabinet, wherein said plurality of fans is divided into a first group of fans and a second group of fans, wherein said plurality of fans comprises individual fans of said first group of fans arranged in an alternating pattern with individual fans from said second group of fans, said plurality of fans extending in the alternating pattern parallel to a horizontal axis of said refrigerated display cabinet, wherein, in a section following the evaporator and preceding the plurality of fans, with respect to the airflow direction in the channel, the channel is divided by partitions into a plurality of conduits, wherein each of said conduits is configured to direct an airflow from a set of channels of said evaporator to a respective one of said plurality of fans, wherein each of the fans of said first group of fans is associated with a deflector configured to divert the airflow from a respective one of the conduits towards the lower area of the product display compartment, as the second flow of refrigerated air, wherein the fans of said second group of fans have no such associated deflector such that each fan of said second group of fans is configured to direct the airflow from a respective one of the conduits towards the outlet mouth, to form the first flow of refrigerated air, wherein said refrigerated display cabinet further comprises a control unit programmed to adjust a speed of the first group of fans independently of a speed of the second group of fans so as to adjust a flow rate of the first flow of refrigerated air independently of a flow rate of the second flow of refrigerated air.

2. The refrigerated display cabinet of claim 1, wherein said channel comprises a first section arranged at a base of said refrigerated display cabinet, a second section arranged on a rear wall of said refrigerated display cabinet in a position opposite said access opening, and a third section arranged at a top of said refrigerated display cabinet, and wherein said air inlet mouth is in communication with said first section, said evaporator and said plurality of fans being arranged in said second section, and said air outlet mouth being in communication with said third section.

3. The refrigerated display cabinet of claim 2, wherein said second section of the channel is divided into a lower section, which extends from the first section up to a height of said shelf, and into an upper section, which extends from the height of said shelf up to the third section.

4. The refrigerated display cabinet of claim 3, wherein said evaporator is housed in the lower section of said second section, and said plurality of fans is housed in the lower section of said second section at the height of said shelf, in a connection area between the lower section and the upper section.

5. The refrigerated display cabinet of claim 3, comprising an air space obtained between a rear panel of the product display compartment and the lower section of the second section of said channel.

6. The refrigerated display cabinet of claim 5, wherein said channel is in communication with the lower area of the product display compartment by means of a first connection opening obtained on the rear panel of the product display compartment.

7. The refrigerated display cabinet of claim 6, wherein said first connection opening puts the lower area of the product display compartment in communication with said air space, and wherein said air space is in communication with the second section of said channel by means of the first group of fans.

8. The refrigerated display cabinet of claim 6, wherein said first connection opening is obtained below said shelf.

9. The refrigerated display cabinet of claim 1, wherein said shelf is a blowing shelf which is fluidically connected to said channel by a second connection opening obtained on a rear panel of the product display compartment.

10. The refrigerated display cabinet of claim 9, wherein the refrigerated display cabinet comprises an air space formed between the rear panel of the product display compartment and the lower section of the second section of said channel, wherein said second connection opening puts said blowing shelf in communication with said air space, and wherein said air space is in communication with the second section of said channel by means of the first group of fans.

11. The refrigerated display cabinet of claim 1, wherein the fans of both groups operate in suction on a common chamber defined by a section of said channel placed downstream of said evaporator and by a dividing wall arranged inside said section of the channel, on said dividing wall and on at least one wall of said channel a plurality of through openings being obtained which act as seats for the fans of both groups.

12. The refrigerated display cabinet of claim 1, wherein the evaporator is a finned evaporator which internally defines through internal parallel fins, arranged orthogonally with respect to a main axis of the refrigerated display cabinet, parallel passage channels for passage of air flow and is arranged inside said channel so that the parallel passage channels are aligned with the air flow direction along said channel.

13. The refrigerated display cabinet of claim 12, wherein the conduits coupled with the fans of the first group of fans intercept a different number of parallel passage channels of said evaporator, with respect to a number of parallel passage channels intercepted by the conduits coupled with the fans of the second group of fans, proportionately to power required by the areas of the product display compartment.

* * * * *